US009606476B2

(12) United States Patent
Mor-Yosef et al.

(10) Patent No.: US 9,606,476 B2
(45) Date of Patent: Mar. 28, 2017

(54) CAST DEVICE WITH IMPLANTED TUBES

(75) Inventors: Avichay Mor-Yosef, Jerusalem (IL); Eran Schwimmer, Nes Ziona (IL); Yaniv Yona, Nes Ziona (IL)

(73) Assignee: Hewlett-Packard Indigo B.V., Amstelveen (NL)

( * ) Notice: Subject to any disclaimer, the term of this patent is extended or adjusted under 35 U.S.C. 154(b) by 189 days.

(21) Appl. No.: 14/373,494

(22) PCT Filed: Jan. 31, 2012

(86) PCT No.: PCT/EP2012/051600

§ 371 (c)(1),
(2), (4) Date: Jul. 21, 2014

(87) PCT Pub. No.: WO2013/113375

PCT Pub. Date: Aug. 8, 2013

(65) Prior Publication Data

US 2015/0031515 A1 Jan. 29, 2015

(51) Int. Cl.

*G03G 15/14* (2006.01)
*G03G 15/16* (2006.01)
*G03G 15/20* (2006.01)

(52) U.S. Cl.

CPC ..... *G03G 15/14* (2013.01); *G03G 15/167* (2013.01); *G03G 15/2053* (2013.01); *G03G 2215/00679* (2013.01); *G03G 2215/1695* (2013.01); *Y10T 428/12292* (2015.01)

(58) Field of Classification Search

CPC ..... B41F 13/22; B41F 13/18; B41F 23/0416; B41F 23/042; B41F 23/0476; B41F 23/0479; B41F 31/002; B41F 3/52; B41F 3/54; B41L 23/20; Y10T 29/4956; Y10T 29/49563; Y10T 29/49565; G03G 15/14; G03G 15/2053; G03G 15/167; G03G 2215/00679; G03G 2215/1695

USPC ..... 399/94

See application file for complete search history.

(56) References Cited

U.S. PATENT DOCUMENTS 1,675,274 A * 6/1928 Miller ..... F28F 5/02 165/89
2,837,833 A * 6/1958 Coudriet ..... B41F 23/042 34/124
3,103,346 A * 9/1963 Buckholdt ..... C03B 35/183 432/236
3,780,796 A * 12/1973 Miram ..... B41F 13/22 165/247
4,050,510 A 9/1977 Theysohn
4,074,750 A * 2/1978 Beghin ..... B22D 11/1287 164/448
4,712,475 A * 12/1987 Kemmerer ..... B41F 31/002 101/348

(Continued)

FOREIGN PATENT DOCUMENTS

CN 2034880 U 3/1989
CN 101412308 A 4/2009

(Continued)

*Primary Examiner* — Jason L Vaughan
(74) *Attorney, Agent, or Firm* — HP Inc. Patent Department

(57) ABSTRACT

A cast device useable with an image forming apparatus is provided. The cast device includes at least one tube and a cast body. The cast body includes the at least one tube implanted into the cast body using a combined casting process.

19 Claims, 8 Drawing Sheets

(56) References Cited

U.S. PATENT DOCUMENTS

| | | | | |
|---|---|---|---|---|
| 5,369,884 | A * | 12/1994 | Chen | B30B 9/20 241/293 |
| 5,448,040 | A * | 9/1995 | Deplano | F27D 9/00 219/647 |
| 5,753,165 | A * | 5/1998 | Watanabe | B29C 39/028 264/138 |
| 5,881,643 | A | 3/1999 | Silvestre | |
| 6,293,014 | B1 | 9/2001 | Kitazawa et al. | |
| 6,708,407 | B2 * | 3/2004 | Leinonen | D21F 5/022 29/895.32 |
| 6,820,336 | B2 * | 11/2004 | Laitinen | B22F 5/10 29/895.22 |
| 6,971,174 | B2 * | 12/2005 | Liu | B22D 11/0651 29/895 |
| 2004/0144270 | A1 | 7/2004 | Dauner | |
| 2004/0168602 | A1 | 9/2004 | Blohdorn | |
| 2006/0236543 | A1 | 10/2006 | Felgenhauer et al. | |
| 2007/0193463 | A1 * | 8/2007 | Hoffmann | B41F 13/22 101/487 |
| 2008/0014003 | A1 | 1/2008 | Smeyers et al. | |

FOREIGN PATENT DOCUMENTS

| | | | |
|---|---|---|---|
| DE | 19957943 | A1 | 6/2001 |
| DE | 10124791 | A1 | 1/2002 |
| EP | 0733478 | A1 | 9/1996 |
| JP | 8248797 | A | 9/1996 |
| JP | 2006098973 | A | 4/2006 |
| JP | 2007101788 | A | 4/2007 |

* cited by examiner

CAST DEVICE WITH IMPLANTED TUBES

BACKGROUND

Image forming apparatuses, such as liquid electrophotography (LEP) systems, form images on media. Liquid electrophotography systems include a fluid applicator unit, a photoconductive member, an image transfer member, and an impression member. The image formed on the photoconductive member is transferred to the image transfer member, and then is provided to the media. An impression member may be used to transfer the image from the image transfer member to the media. Regulating the temperature of the media may be used to assist with the transfer of the image to the media.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

An impression member formed from a cast device is described herein. During the printing process, the temperature of the paper may need to be regulated to avoid low print quality. For example, the value of thermal resistance between the impression member and the media may cause the impression member to obtain a temperature above or below a predetermined temperature for printing, such as above or below fifty degrees Celsius. Low print quality may occur when the temperature of the media varies above and/or below the predetermined temperature. Accordingly, efficiently and uniformly regulating the temperature of an impression member to maintain the media at the predetermined temperature is desired.

Regulating the temperature of the impression member may also regulate the temperature of the media. For example, the value of thermal resistance between a thin media and the impression member may cause the impression member to reach a temperature in excess of the predetermined temperature, resulting in the media heating to a temperature above the predetermined temperature. Conversely, the value of thermal resistance between a thick media and the impression member may cause the impression member to reach a temperature below the predetermined temperature, resulting in the media cooling to a temperature below the predetermined temperature. Moreover, the temperature of the impression member may need to be adjusted between print jobs. For example, the temperature of the impression member may need to be adjusted between a first and second print job when the print jobs have different types of media, such as different thicknesses and/or different surface properties. Thus, efficiently and uniformly regulating the temperature of the impression member may assist with regulating the temperature of the media.

In examples, a cast device useable with an image forming apparatus is provided. The cast device includes at least one tube and a cast body. The at least one tube is implanted into the cast body using a combined casting process.

Figure 1:
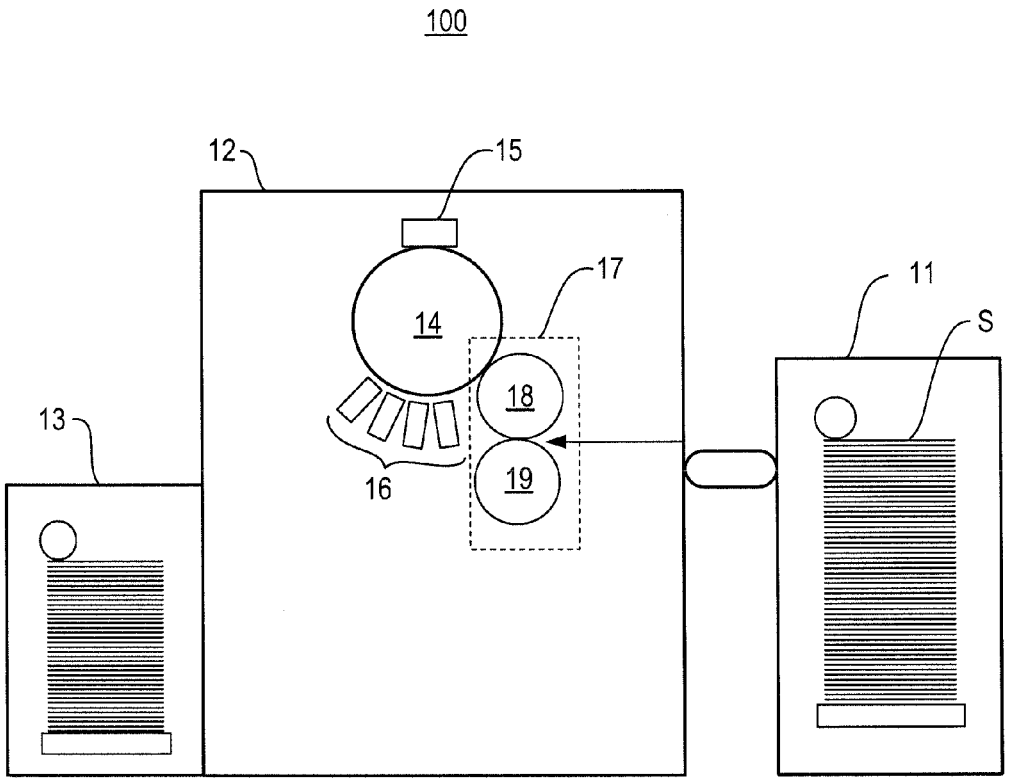
FIG. 1 illustrates a schematic view of a liquid electrophotography system according to an example.

FIG. 1 illustrates a schematic view of an image forming apparatus, such as a liquid electrophotography (LEP) system, according to an example. The LEP system 100 includes an image forming unit 12 that receives a media S from an input unit 11 and outputs the media S to an output unit 13. The image forming unit 12 includes a photoconductive member 14 on which images may be formed. The photoconductive member 14 may be charged with a suitable charger (not illustrated), such as a charge roller. Portions of the outer surface of the photoconductive member 14 that correspond to the features of the image may be selectively discharged by a laser writing unit 15 to form an electrostatic and/or latent image thereon.

Referring to FIG. 1, the LEP system 100 also includes an applicator unit 16 to apply ink, such as a liquid toner, for example, Electrolnk, trademarked by Hewlett-Packard Company, to the electrostatic and/or latent image on the photoconductive member 14. The ink is applied to the photoconductive member 14 to form an image to be transferred to a roller system 17, including an intermediate transfer member (ITM) 18 and a roller device 19, for example, an impression drum. The ITM 18 receives the image from the photoconductive member 14, heats the image, and transfers the image to the media S. For example, the ITM 18 may be heated to one hundred and ten degrees Celsius to properly transfer the image to the media S, which is wrapped around the impression drum or roller device 19 that is maintained at fifty degrees Celsius. Heat from the ITM 18 may also transfer to the roller device 19. During the transfer of the image from the ITM 18 to the media S, the media S is pinched between the ITM 18 and the roller device 19. Once the image has been transferred to the media S, the media S may be transported to the output unit 13.

Figure 2:
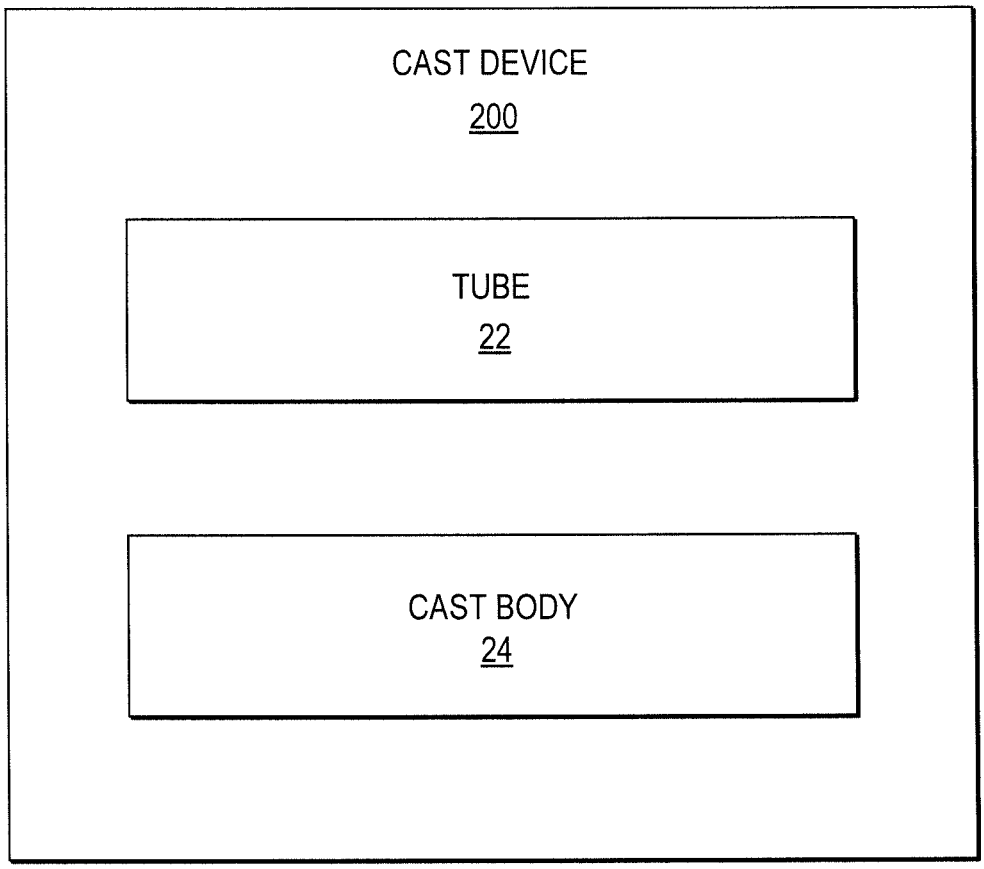
FIG. 2 illustrates a block diagram of a cast device according to an example.

The roller device 19 of FIG. 1 may be, for example, a cast device. FIG. 2 illustrates a block diagram of a cast device 200 according to an example. The cast device 200 includes at least one tube 22 and a cast body 24. The cast device 200 includes the at least one tube 22 implanted into the cast body 24 using a combined casting process. The at least one tube 22 is implanted into the cast body 24 to form a thermal connection between the at least one tube 22 and the cast body 24. The at least one tube 22 is formed of a first iron composition, such as a steel composition, for example, at least one of SAE 1020, ST37, and SST 316. The cast body 24 is cast of a second iron composition, such as gray irons GGG50, GGG25, and GG60. The first and second iron compositions are distinct and have different melting temperatures, such that the first iron composition of the at least one tube 22 has a melting temperature greater than the melting temperature of the second iron composition of the cast body to enable combined casting.

Figure 3:
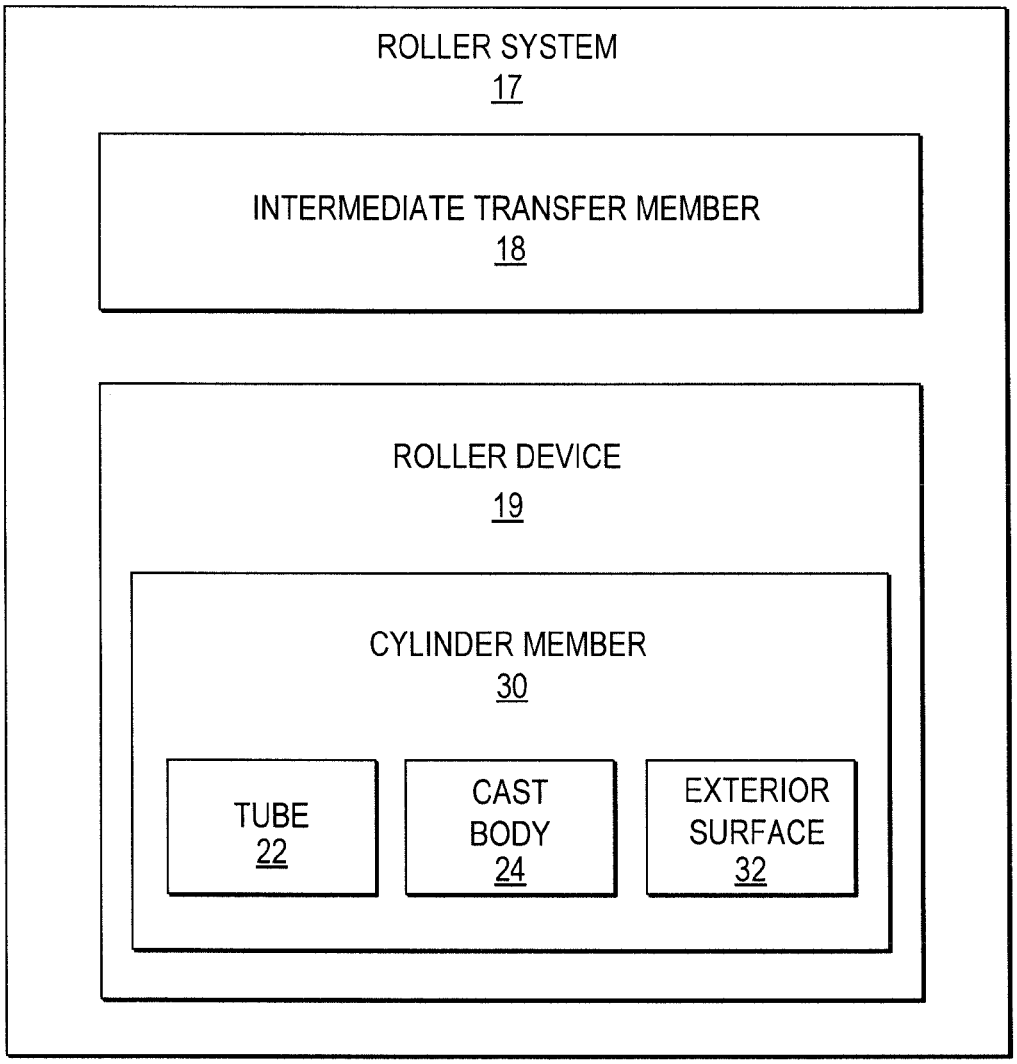
FIG. 3 illustrates a block diagram of a roller system according to an example.
Figure 4:
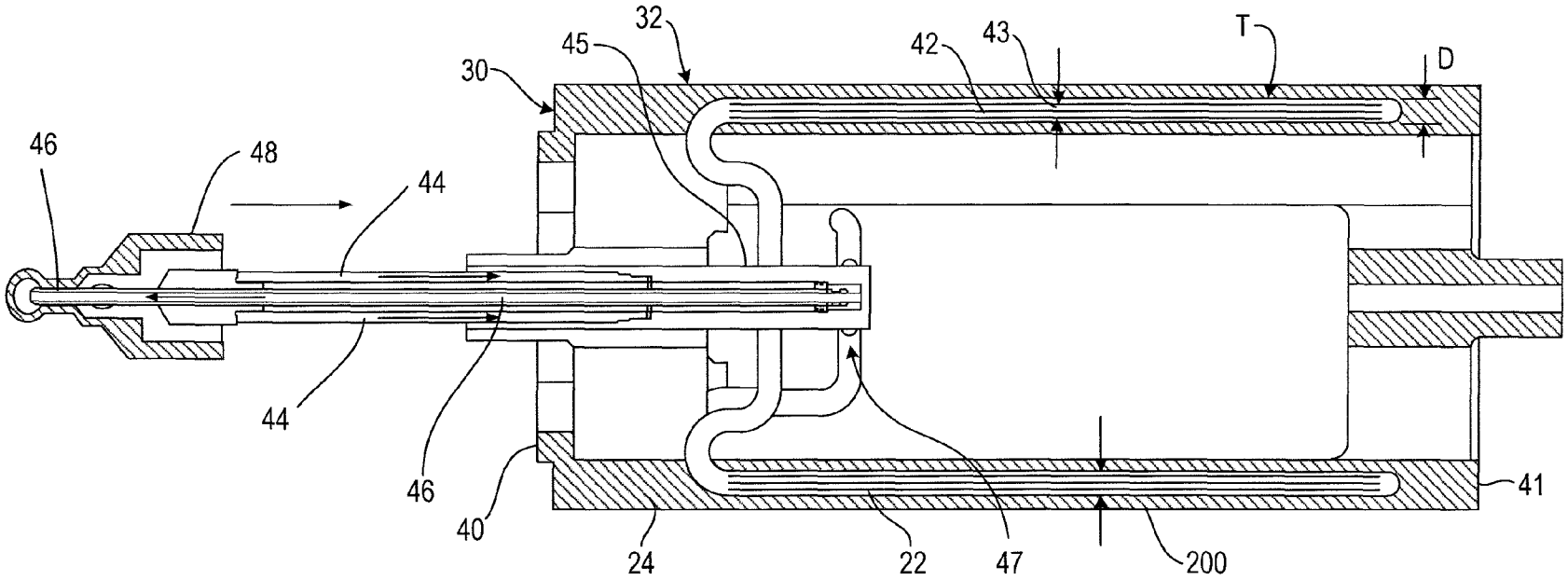
FIG. 4 illustrates a cross-sectional view of a roller system according to an example.

The cast body 24 may be formed in various shapes and sizes. Based on the shape and size of the cast body 24, the at least one tube 22 is formed and implanted into the cast body 24 at a predetermined position having a fixed degree of freedom. By casting the at least one tube 22 into the cast body 24 of the cast device 200, the additional costs of deep drilling tunnels and adding seals to plug the end of each tunnel may be avoided. Furthermore, the at least one tube 22 may include bent tubes that reduce the number of seals and reduce the opportunity for fluid leakage. FIGS. 3-4, below, illustrate a roller device 19 that includes a cast device 200.

FIG. 3 illustrates a block diagram of a roller system 17 according to an example. The roller system 17 is usable with an image forming apparatus, such as the LEP system (100) of FIG. 1. The roller system 17 includes an intermediate transfer member 18 and a roller device 19. For example, the intermediate transfer member 18 transfers an image to media.

The roller device 19 is disposed adjacent to the intermediate transfer member 18. The roller device 19 includes a cylinder member 30 rotatable about a longitudinal axis extending therethrough. The cylinder member 30 includes a cast body 24, at least one tube 22 implanted into the cast body 24, and an exterior surface 32 disposed on an outer portion of the cast body 24. The at least one tube 22 circulates a fluid 42 therein to uniformly regulate a temperature of the cylinder member 30. The fluid 42 includes at least one of water, air, and imaging oil. The at least one tube is formed in a pattern that extends longitudinally therethrough. The exterior surface 32 to press media against the intermediate transfer member 18 to transfer the image from the intermediate transfer member 18 to the media. An example of the media is paper, but the media is not limited to paper.

FIG. 4 illustrates a cross-sectional view of a portion of a roller system 17 according to an example. The roller system 17 may be part of an image forming apparatus. The roller device 19 is illustrated as an impression drum disposed adjacent to the intermediate transfer member 18. For example, the roller device 19 may be a cast iron impression drum weighing approximately four hundred kilograms with a diameter of approximately three hundred and ninety millimeters and a length of approximately nine hundred millimeters.

The roller device 19 includes a cylinder member 30 that is rotatable about a longitudinal axis that extends therethrough. The cylinder member 30 may be formed of a cast device 200 with a cast body 24 and at least one tube 22 cast therein. The at least one tube 22 is cast in a pattern that extends longitudinally therethrough between two opposing ends 40, 41. The at least one tube 22 uniformly regulates a temperature of the cylinder member 30 through the circulation of a fluid 42 throughout the cast body 24.

As illustrated in FIG. 4, the thermal connection between the at least one tube 22 and the cast body 24 allows the transfer of heat between the cylinder member 30 and the fluid 42. For example, the fluid 42 may start as cold water that is circulated through the at least one tube 22 to cool the cylinder member 30. The heat 43 from the cylinder member 30 contacts the at least one tube 22 carrying the fluid 42, i.e., cold water. The cold water receives the heat 43 from the cylinder member 30, heating the cold water. The heat is transported out of the cylinder member 30 with the heated cold water, which lowers the temperature of the cylinder member 30. The heated cold water exits the cylinder member 30 via the at least one tube 22 connected to, for example, an outlet tube 46. Conversely, the fluid 42 may be hot water used to heat the cylinder member 30. The hot water is circulated through the at least one tube 22 to provide heat to the cast body 24, which heats the cylinder member 30. The material of the cast body 24 may be an iron composition, such as spheroidal graphite cast iron, DIN EN 1563, and defined as GGG50, GGG25, and/or GG60. The at least one tube 22 may be a plurality of straight tubes and/or at least one bent tube formed of an iron composition, such as a steel composition, for example, at least one of SAE 1020, ST37, and SST 316. The iron composition of the at least one tube 22 has a melting temperature that is greater than the melting temperature of the iron composition of the cast body 24 for combined casting. For example, the melting temperature of the iron composition of the at least one tube 22 may be at least two hundred degrees greater than the melting temperature of the iron composition of the cast body 24. The at least one tube 22 may have a thickness, T, which may vary between, for example, one of one millimeter, one and a half millimeters, and two millimeters. The at least one tube 22 may also have an aperture with a diameter, D, of, for example, twenty millimeters.

The cylinder member 30 further includes an exterior surface 32 to press media against the intermediate transfer member 18 to transfer the image from the intermediate transfer member 18 to the media. The exterior surface 32 is an outer portion the cast body 24. The exterior surface 32 may be made of the same material as the cast body 24 (i.e., an iron composition) and/or a coating or plating around the outer portion of the cast body 24. The at least one tube 22 may be implanted into the cast body 24 with a thermal connection that allows the fluid 42 in the at least one tube 22 to heat and/or cool the cylinder member 30 to maintain the exterior surface 32 at a predetermined uniform temperature.

The roller device 19 further includes an inlet tube 44 and an outlet tube 46. The inlet tube 44 is attached to the cylinder member 30 of the roller device 19 and provides the fluid 42 to the at least one tube 22. The outlet tube 46 is attached to the cylinder member 30 and transports the fluid 42 out of the at least one tube 22. For example, the inlet tube 44 may connect to an inlet end 45 of the at least one tube 22 to circulate the fluid 42 throughout the at least one tube 22 and the outlet tube 46 may similarly connect to an outlet end 47 of the at least one tube 22. The arrangement of the at least one tube 22 may vary as illustrated in FIGS. 5-6 below.

A rotary joint 48 may connect to the inlet tube 44 and the outlet tube 46 to enable rotation of the roller device 19, while enabling linear fluid 42 to flow into and/or out of the roller device 19. The rotary joint 48 may also connect the inlet tube 44 and/or the outlet tube 46 to the roller device 19. The inlet tube 44 may, for example, encase the outlet tube 46 between the rotary joint 48 and the roller device 19, as illustrated in FIG. 4. For example, the inlet tube 44 may pass through the rotary joint 48, extend to the roller device 19, and connect to the at least one tube 22. The fluid 42 flows from the inlet tubes 44 inside the roller device 19 and spread towards the exterior surface 32 in a radial direction through the roller device 19 via the at least one tube 22, which extends longitudinally therein. The at least one tube 22 is connected to the outlet tube 46, which is connected to the rotary joint 48 to take the fluid out of the at least one tube 22 through the rotary joint 48.

Figure 5:
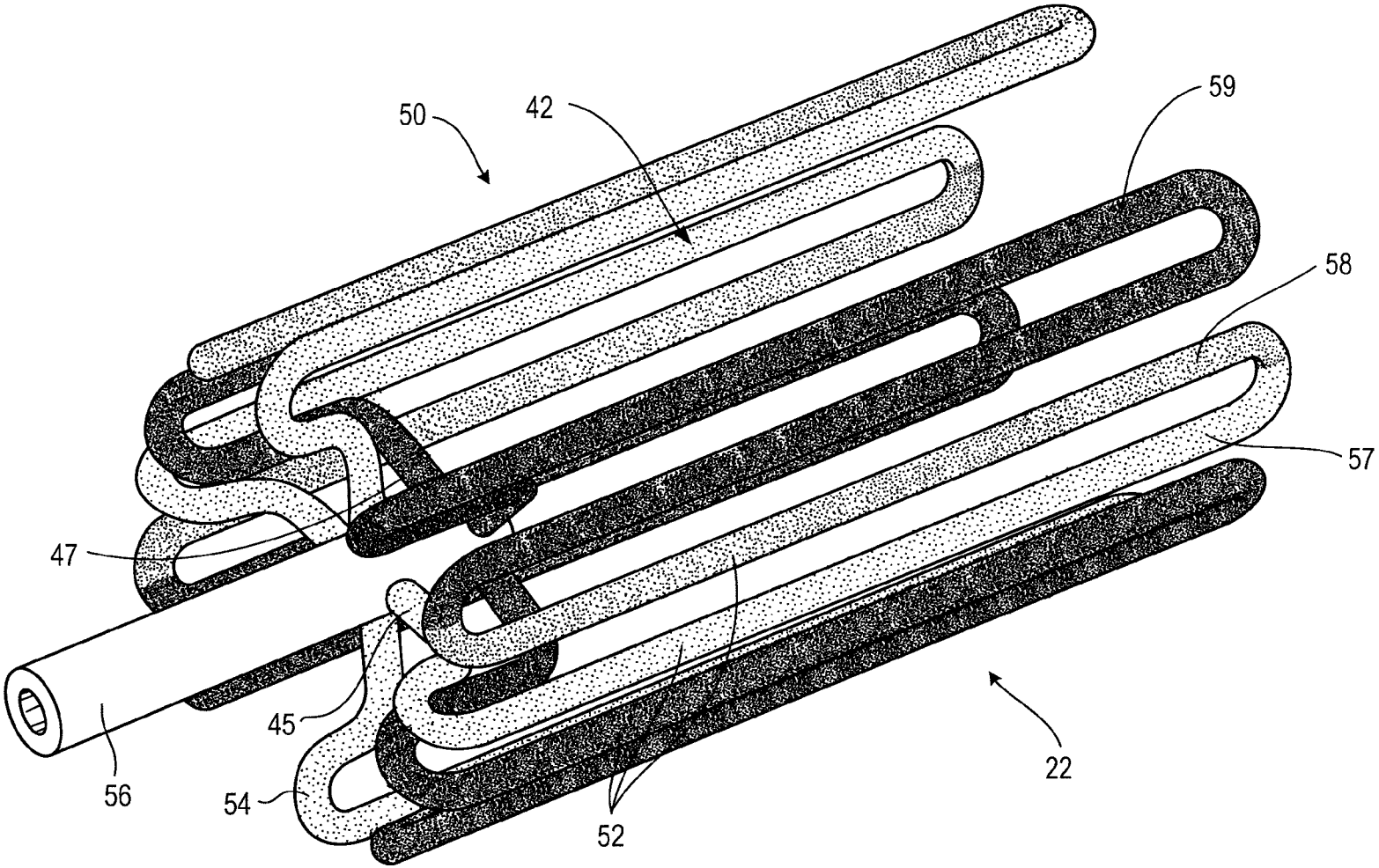
FIG. 5 illustrates a perspective view of a portion of the roller device according to an example.
Figure 6:
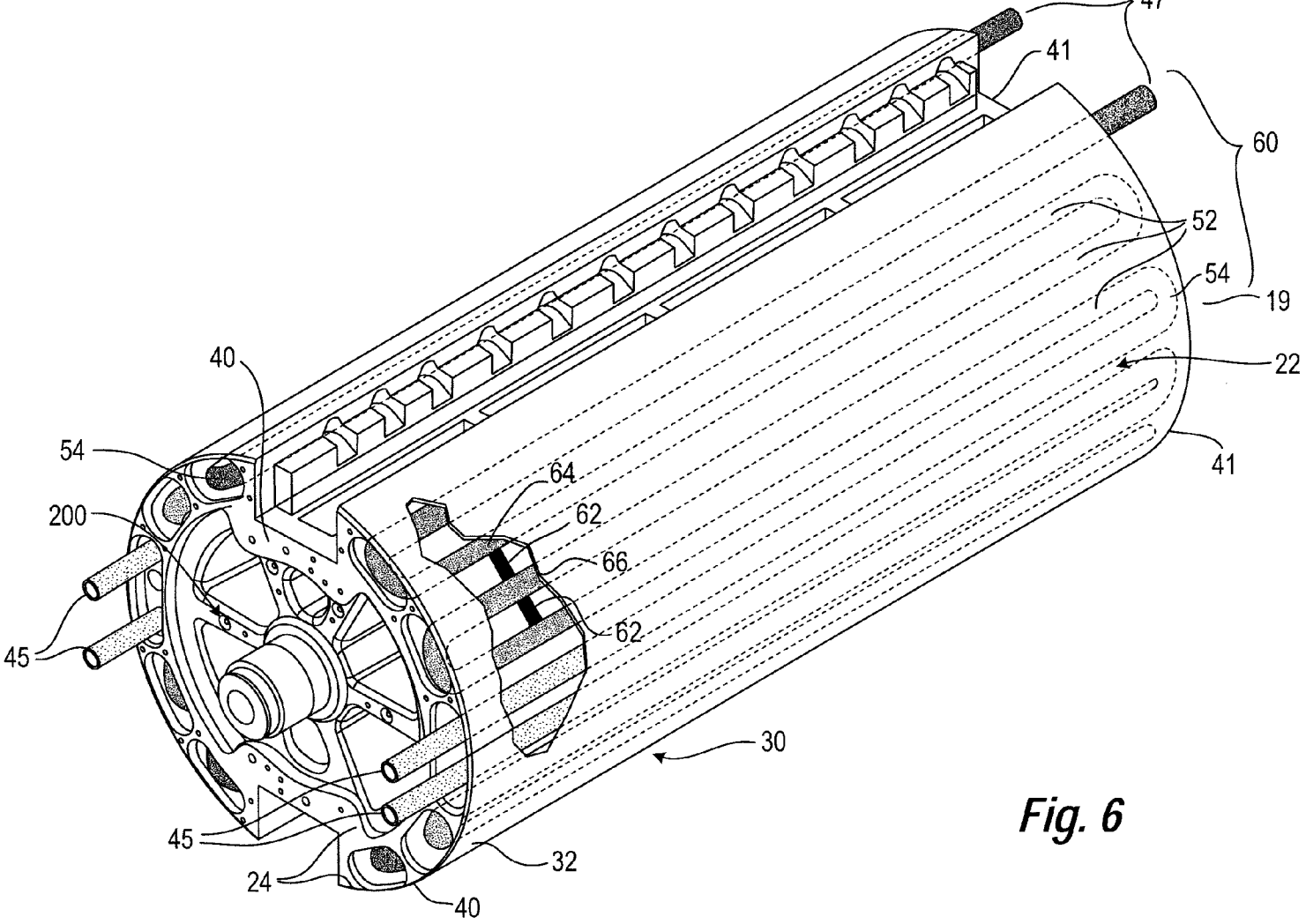
FIG. 6 illustrates a perspective view of a roller device according to a further example.

FIG. 5 illustrates a perspective view of the at least one tube 22 of the roller device 17 according to an example. The at least one tube 22 is illustrated as a first predetermined pattern 50 including four tubes formed to attach to a single rotary joint 48, as illustrated in FIG. 4. The at least one tube 22 is illustrated as four tubes with at least two portions. The tubes each include a plurality of longitudinal portions 52 and a plurality of bent portions 54. As illustrated, the longitudinal portions 52 are approximately parallel to one another and are connected to one another by the bent portions 54. The plurality of longitudinal portions 52 may also be approximately parallel to the exterior surface 32 as illustrated above in FIG. 4. The bent portions 54 are also illustrated as connected to the inlet end 45 and the outlet end 47 of the at least one tube 22. For example, the four tubes 50 are attached to a transition tube 56 that provides the fluid 42 to the inlet end 45 and receives the fluid 42 from the outlet end 47.

The four tubes 50 direct the fluid 42 to flow into and out of the same side 40 of the cast device 200, such as the roller device 19. Moreover, FIG. 5 illustrates shading in the at least one tube 22 that corresponds to the temperature of the fluid 42. For example, when cold water is used to cool the roller device 17, the cold water on the inlet end 45 is illustrated with light shading 57. As the cold water receives heat from the roller device 17, the shading is illustrated as a medium shading 58 and then becomes a darker shading 59 as the heated cold water is transported out of the at least one tube 22 at the outlet end 47.

FIG. 6 illustrates a perspective view of the roller device 19 according to an example. The roller device 19 includes the cylinder member 30 including the at least one tube 22, the cast body 24, and the exterior surface 32. The at least one tube 22 is cast in the cast body 24 using four separate tubes that form a second predetermined pattern 60. The at least one tube 22 includes a plurality of longitudinal portions 52 that extend longitudinally across the cylinder member 30 and a plurality of bent portions 54 connecting the longitudinal portions 52. For example, the plurality of longitudinal portions 52 may be approximately parallel to one another and approximately parallel to the exterior surface 32. The plurality of longitudinal portions 52 may also include at least one support member 62 between a first portion and a second portion of the at least one tube 22 to position the at least one tube. For example, the at least one support member 62 is positioned between a first longitudinal tube 64 and a second longitudinal tube 66 to hold the first and second longitudinal tubes 64, 66 in the second predetermined pattern 60 such that the fluid 42 is uniformly circulated throughout the roller device 19.

FIG. 6 illustrates the inlet end 45 and the outlet end 47 of the at least one tube 22 located on opposite ends 40, 41 of the cylinder 30. Accordingly, when the inlet tube 42 and the outlet tube 46 are located on opposite ends 40, 41 of the cylinder 30, a rotary joint 48, as illustrated in FIG. 4, will be located on both sides of the cylinder member 30.

The first and second predetermined patterns 50, 60 of FIGS. 5-6 allow for efficient and uniform circulation of the fluid within the cast body 24, which maintains the temperature of the exterior surface 32 of the roller device 19 at a predetermined temperature. This configuration is important during printing, such that the fluid is circulated through the at least one tube 22 in a manner that maintains the exterior surface 32 at a uniform temperature, such as within two degrees Celsius of fifty degrees Celsius and/or adjusts the temperature of the exterior surface 32 for increases or decreases thereto. The fluid 42 circulated through the at least one tube 22 to uniformly regulate a temperature of the cylinder member 30 may include a temperature regulating substance, such as water, imaging oil, or the like.

Moreover, use of the roller device 19 with the at least two tubes 22 in an image forming apparatus may increase productivity of the image forming apparatus by minimizing the transient time needed to heat and/or cool the roller device 19 between changing of a printing media and/or between print jobs. For example, a fluid 42, such as water, is circulated through the at least two tubes 22. The at least two tubes 22 extend longitudinally within the cast body 24 close to the exterior surface 32 with a thermal connection therebetween to efficiently and uniformly heat and/or cools the exterior surface 32 using the fluid 42. In some examples, the fluid 42 may be water instead of air due to water's heating capacity of 4.2 KJ/Kg° C. and thermal conductivity of 0.58 Watt/meter ° K, which enable the heat flow to be transferred more efficiently with lower mass flow. In such an example, the roller device 19 may be quickly heated and/or cooled, which may reduce the amount of down time between print jobs and increase productivity of the image forming apparatus.

Figure 7:
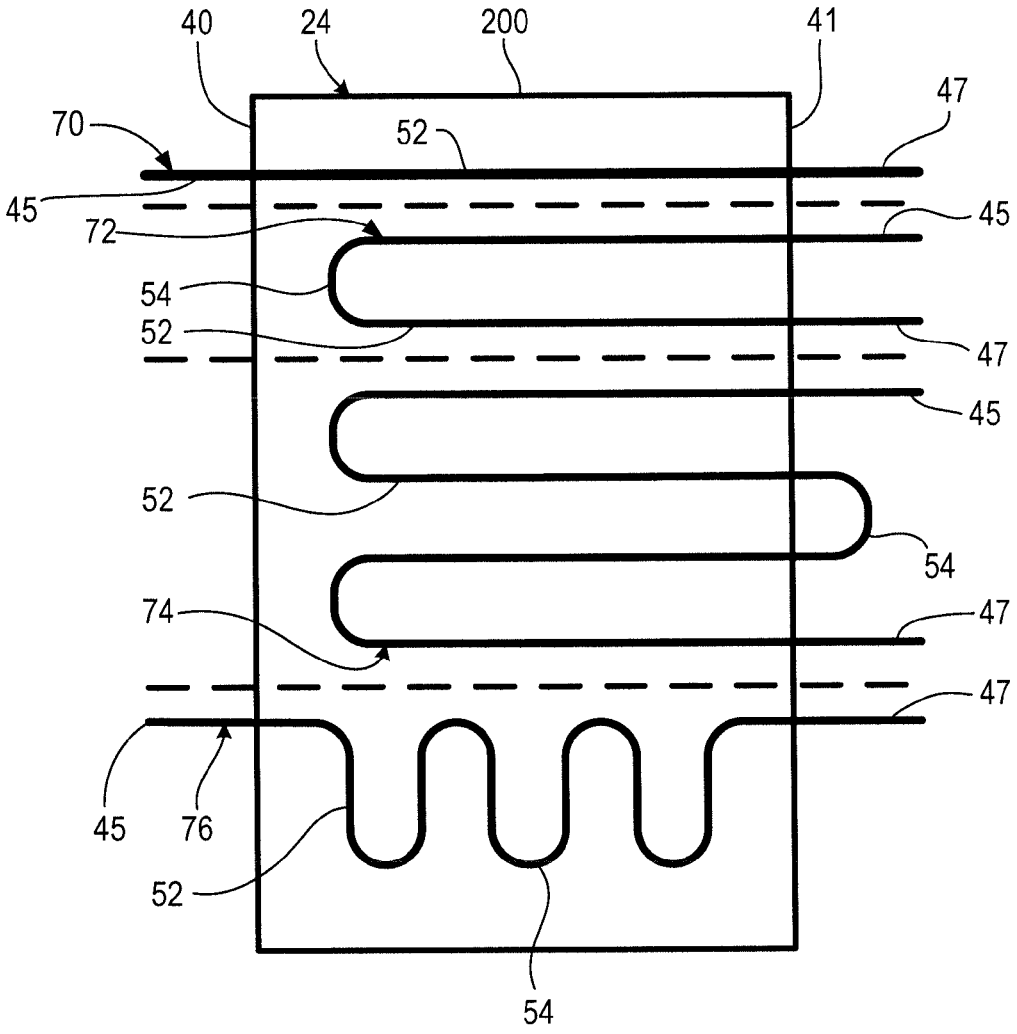
FIG. 7 illustrates a schematic view of various tube formations according to examples.

FIG. 7 illustrates a schematic view of various tube formations according to an example. For example, the at least one tube 22 may include a plurality of straight tubes 70 each extending longitudinally across the cast body 24 such that the fluid 42 flows in one end 40 of the cast device 200 and out an opposite end 41. The at least one tube 22 may include U-shaped tubes such as a tube with a single U-shape 72 or multiple U-shapes 74 formed therein. The U-shaped tubes extend longitudinally across the cast body 24 and bend within the cast body 24 such that the fluid 42 flows in and out the cast device 200 on the same side and the bent portion 54 remains within the cast body as illustrated in tubes 72. The U-shaped tubes 74 may also be configured such that at least one of the bent portions 54 is not contained within the cast body 24. Moreover, depending on the location of the inlet end 45 and the outlet end 47 of the at least one tube 22, the fluid 42 to flow into and out of opposite ends 40, 41 of the cast body 24, as illustrated above in FIG. 6. Furthermore, the at least one tube 22 that extends longitudinally across the cast device 200 may be formed as a straight tube 70 as illustrated above and/or with the bent portions 54 forming a zigzag pattern 76. Varying tube formations may be used, such that the patterns provides for uniform regulation of the temperature of the cast device 200 through the at least one tube 22.

Figure 8:
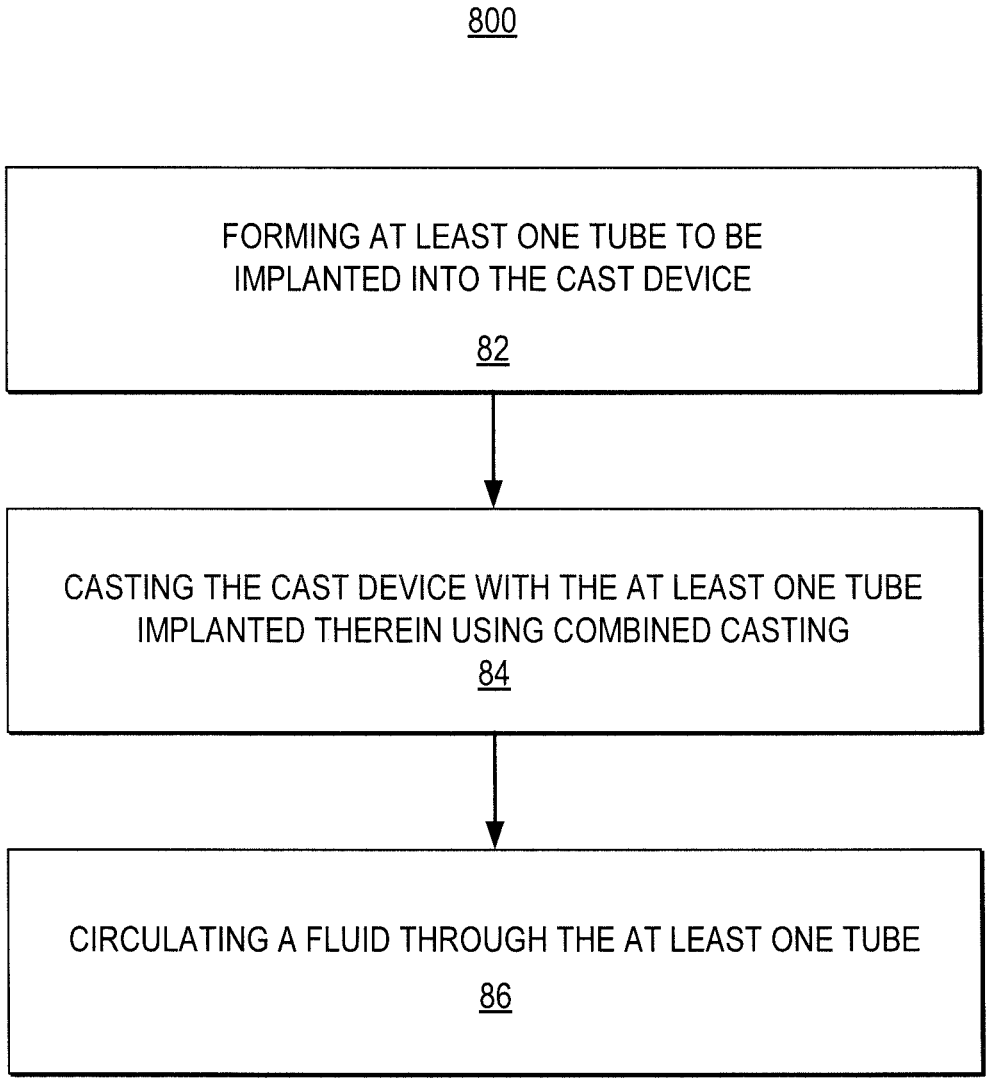
FIG. 8 illustrates a flowchart of a method of regulating temperature of a cast device according to an example.

FIG. 8 illustrates a flowchart a method 800 of regulating temperature of a cast device of an image forming apparatus according to an example. The cast device may be part of a roller device. In block 82, at least one tube is formed to be implanted into the cast device. The at least one tube may be formed of a steel composition. For example, the formation of the at least one tube may include the at least one tube being bent into a predetermined tunneling pattern. At least one support member may be positioned between a first portion and a second portion of the at least one tube to maintain the predetermined tunneling pattern.

The cast device is cast in block 84 with the at least one tube implanted therein using combined casting. The at least one tube is positioned in the cast device such that the at least one tube is parallel to the exterior surface and parallel to one another. The at least one tube as positioned allows for thermal conductivity between the fluid and the exterior surface of the roller device to regulate the temperature of the cast device. A fluid is circulated through the at least one tube in block 86 to maintain the temperature of the cast device. For example, the temperature of the cast device may be maintained between forty-eight degrees Celsius and fifty-two degrees Celsius by circulating the fluid through the at least one tube. For example, the fluid may be water, air and/or imaging oil. Furthermore, the fluid may be cold water when cooling the cast device, and the fluid may be hot water when heating the cast device.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming apparatus comprising:

an image forming unit to form an image for transfer to a print media:

an intermediate transfer member to transfer an image from the image forming unit to the print media;

a roller to regulate a temperature of the print media at image transfer, the roller comprising a cast device, the cast device comprising:

at least one tube formed of a steel composition to transport a fluid; and a cast body formed of an iron composition, the cast body including the at least one tube implanted into the cast body using a combined casting process, the at least one tube is implanted into the cast body to form a thermal connection between the at least one tube and the cast body, the roller disposed adjacent to the intermediate transfer member, the roller including a cylinder member rotatable about a longitudinal axis extending therethrough, the cylinder member comprising the cast body, and the at least one tube implanted into the cast body, and an exterior surface disposed on an exterior surface of the cast body, the exterior surface to press media against the intermediate transfer member to transfer the image from the intermediate transfer member to the print media.

2. The image forming apparatus of claim 1, wherein the cast device comprises a cylinder member rotatable about a longitudinal axis extending therethrough, the cylinder member including the at least one tube cast in a pattern that extends longitudinally therethrough such that the at least one tube uniformly regulates a temperature of the cylinder member through the circulation of a fluid therein.

3. The image forming apparatus of claim 2, wherein the cylinder member further comprises an exterior surface to press media against an intermediate transfer member to transfer the image from the intermediate transfer member to the media.

4. The image forming apparatus of claim 1, further comprising at least one support member to position the at least one tube such that the at least one support member is attached to a first portion and a second portion of the at least one tube.

5. The image forming apparatus of claim 1, wherein the at least one tube comprises a bent steel tube.

6. The image forming apparatus of claim 1, wherein the steel composition of the at least one tube has a melting temperature that is greater than the melting temperature of the iron composition of the cast body.

7. The image forming apparatus of claim 1, wherein the steel composition of the at least one tube comprises at least one of SAE 1020, ST37, and SST 316.

8. The image forming apparatus of claim 1, further comprising wherein the roller further comprises:

an inlet tube to provide fluid to the at least one tube to regulate temperature of the roller and print media; and an outlet tube to transport the fluid out of the at least one tube.

9. The image forming apparatus of claim 8, wherein the fluid comprises at least one of water, air, and imaging oil.

10. The image forming apparatus of claim 8, wherein the at least one tube comprises at least two portions having at least one support member therebetween to position each of the at least two portions such that the fluid is uniformly circulated throughout the roller device.

11. The image forming apparatus of claim 1, wherein, when changing between print jobs for which the roller needs to be at a different temperature, the image forming apparatus to adjust a temperature of the roller by circulating fluid through the at least one tube implanted in the cast body.

12. The image forming apparatus of claim 1, wherein the at least one tube has a zigzag pattern inside the cast body.

13. A method of forming an image forming apparatus comprising an image forming unit to form an image for transfer to a print media; an intermediate transfer member to transfer an image from the image forming unit to the print media; and a roller to regulate a temperature of the print media at image transfer, the roller comprising a cast device; the method comprising;

casting the cast device with at least one tube implanted into a cast body thereof using combined casting, such that the at least one tube allows for thermal conductivity between a fluid circulating in the at least one tube and an exterior surface of the cast device to regulate the temperature of the cast device, the roller and the print media; the cast device being sized for installation in the image forming unit; and disposing the roller adjacent to the intermediate transfer member, the roller including a cylinder member rotatable about a longitudinal axis extending therethrough, the cylinder member comprising the cast body, and the at least one tube implanted into the cast body.

14. The method of claim 13, further comprising positioning the at least one tube in the cast device such that the at least one tube is parallel to the exterior surface.

15. The method of claim 13, wherein further comprising, prior to casting, forming the at least one tube, including bending the at least one tube in a predetermined tunneling pattern.

16. The method of claim 15, wherein forming at least one tube further comprises attaching at least one support member between a first portion and a second portion of the at least one tube to maintain the predetermined tunneling pattern of the at least one tube.

17. The method of claim 13, further comprising providing:

an inlet tube to provide the fluid to the at least one tube; and an outlet tube to transport the fluid out of the at least one tube;

such that, when changing between print jobs for which the roller needs to be at a different temperature, the image forming apparatus to adjust a temperature of the roller by circulating fluid through the at least one tube implanted in the cast body.

18. The method of claim 13, wherein the at least one tube is formed of a steel composition.

19. The method of claim 13, wherein the cast body formed of an iron composition.

* * * * *